United States Patent [19]

Harper et al.

[11] Patent Number: 4,851,736

[45] Date of Patent: Jul. 25, 1989

[54] HELICAL WAVEGUIDE TO RECTANGULAR WAVEGUIDE COUPLER

[75] Inventors: Robert Harper, Concord, Mass.; Cheryl V. Liss, Merrimack, N.H.

[73] Assignee: Raytheon Company, Lexington, Mass.

[21] Appl. No.: 201,804

[22] Filed: Jun. 3, 1988

[51] Int. Cl.[4] ..... H01J 25/34; H01P 5/08

[52] U.S. Cl. ..... 315/3.5; 333/21 R; 333/162; 333/33

[58] Field of Search ..... 333/162, 33, 21 R, 230; 315/3.5, 39.3, 39.53

[56] References Cited

U.S. PATENT DOCUMENTS

| | | | |
|---|---|---|---|
| 2,760,112 | 8/1956 | Clarke | 333/162 X |
| 2,761,915 | 9/1956 | Pierce | 315/3.2 |
| 2,806,975 | 9/1957 | Johnson | 333/162 X |

*Primary Examiner*—Paul Gensler

*Attorney, Agent, or Firm*—Martin M. Santa; Richard M. Sharkansky

[57] ABSTRACT

Slow-wave structures are formed by the method of this invention in the form of helical or coupled-cavity structures. A helical waveguide form of slow-wave structure is formed of a solid rod of copper machined with a deep, narrow helical groove. A copper sleeve is brazed to the periphery of the resulting helical thread to form a helically spiraling pathway about a solid axially centered and axially extending center portion. The center portion is then totally eroded away to form a slow wave structure having a helical radially-extending portion, or if only partially eroded with an inner helical axially-extending ridge to provide a helical axially-centered gap between adjacent ridges. The helix is extended into a rectangular waveguide for coupling the slow-wave structure to the source and to the load. The coupled-cavity forms of waveguide slow-wave structures are formed by machining disks from a solid rod of copper. The disks are supported in their desired positions by an axial retained portion of the rod until the disks are brazed inside a cylindrical shell of copper. After brazing, the axial retained portion is removed in whole or part to form the completed slow-wave structure.

12 Claims, 8 Drawing Sheets

HELICAL WAVEGUIDE TO RECTANGULAR WAVEGUIDE COUPLER

BACKGROUND OF THE INVENTION

This invention relates to a helical waveguide to rectangular waveguide coupler and more particularly to the input and output coupler to the helical slow-wave structure of the traveling wave tube.

This invention also relates to the method matching the impedance of the coupler to that of the helical slow-wave structure to provide an input or output impedance which matches the source or load impedance, respectively, coupled to the traveling wave tube.

The desirability of a helical waveguide for providing a slow wave structure has been recognized for many years. The structure of the helical waveguide of this invention consists of half of a rectangular center ridge waveguide wound around in a spiral with a hole down the center for an electron beam. The fundamental mode of propagation of the waveguide is effectively slowed relative to the axial movement of electrons by causing the propagating RF energy to follow the spiral pathway.

Although conceptually simple in design, a problem is how to make such a helical waveguide structure and its coupler, especially for high frequency tubes where the waveguide dimensions are measured in the hundredths of inches.

SUMMARY OF THE INVENTION

It is therefore a primary object of this invention to provide an improved coupler structure for coupling into and out of a helical delay line or slow-wave structure for use in a traveling wave tube.

Another object of this invention is to provide a coupler having improved impedance matching characteristics for coupling into and out of a helical delay line for use in a traveling wave tube over that previously available.

The foregoing and other objects of this invention are attained generally by initially forming a helical delay line from a solid cylinder of high electrical conductivity material by conventional and electric discharge machining operations. Brazing operations to form the completed delay lines are limited to joining to the interior of a cylindrical shell to the peripheral portions of the disks supported to form a cylinder or semi-cylinders which are produced by the machining operations.

A helical waveguide form of slow-wave structure is formed of a solid cylindrical rod of copper machined with a deep, narrow helical groove. A copper sleeve is brazed to the outer periphery of the resulting helical vane to form a helically spiraling pathway about a solid axially-centered, axially-extending cylindrical center support portion. The center portion is then either totally or partially eroded away to form a slow-wave structure having an axially-centered beam hole which in one embodiment has helical radially-extending ridges or ferrules which form a part of the inner periphery of the vane thereby providing a helical axially-centered gap between adjacent ridges.

This invention has the advantage that the methods for fabricating the helical traveling wave tube slow-wave circuits and the couplers thereto result in reduced costs of parts, better control of pitch (especially cummulative errors), better beam hole alignment, and lower final assembly labor costs.

BRIEF DESCRIPTION OF THE DRAWINGS

The aforementioned aspects and other features of the present invention will be apparent from the following description taken in conjunction with the accompanying drawings wherein.

DESCRIPTION OF THE PREFERRED EMBODIMENT

Figure 1:
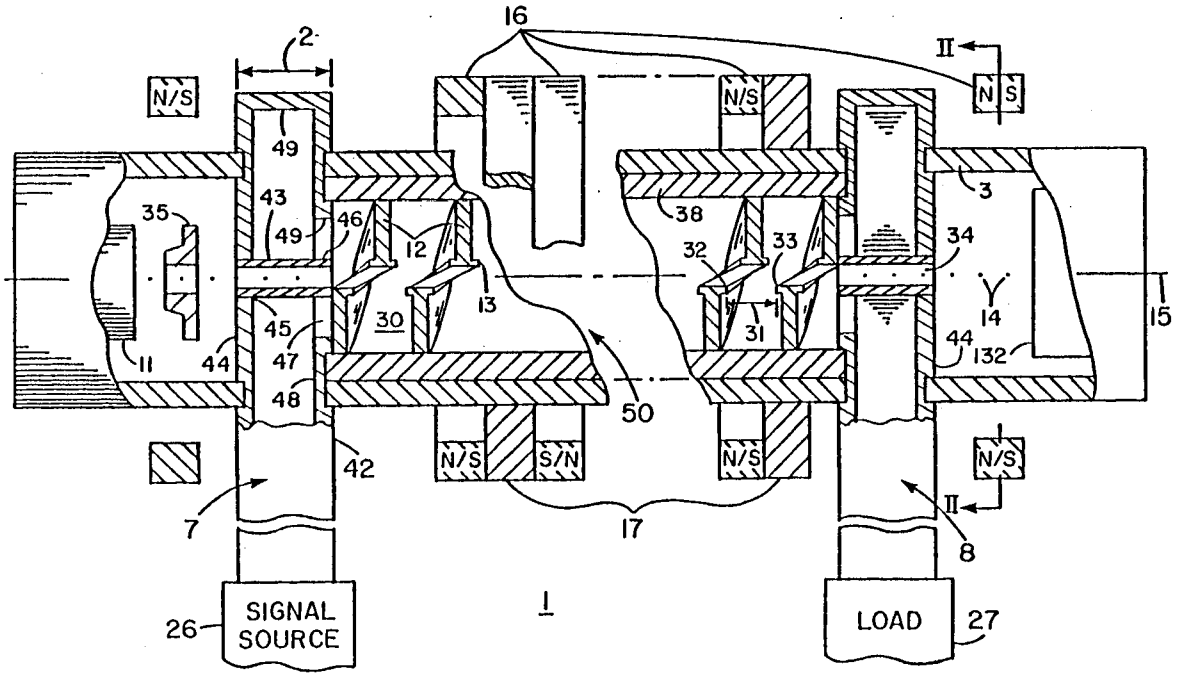
FIG. 1 is a partial sectional view taken along the central axis of a traveling wave tube showing the helical waveguide slow wave structure of the invention.

Referring to FIG. 1, there is shown a longitudinal sectional view of traveling wave tube 1 comprising a cathode 11, which is shown diagrammatically and is understood to include the assembly of the focussing electrodes, and anode 35, and a collector 13 which is also shown diagrammatically, the collector 132 being understood to include a heat sink. The cathode 11 and the anode 35 provide an electron beam 14 along an axis 15 of the slow wave structure shown as the helical waveguide 50. The beam 14 is focussed in a conventional manner by a set of permanent magnets 16 having a toroidal form and interleaved with discs 17 which are shown in simplified form in FIG. 1, the rings 17 being of high-permeability material, such as iron, for shaping the magnetic field at the electron beam 14. Coupling of electromagnetic energy at each end of the slow wave structure 50 is accomplished by input and output couplers 7, 8, respectively. Each coupler 7, 8 consists of a waveguide 42 which extends transversely through tube 1 and its axis 15 and with its narrowest dimension 2 parallel to axis 15. Waveguide 42 contains a cylindrical sleeve 43 which is in axial alignment with axis 15 of slow wave structure 50. Sleeve 43 has the same inside diameter as the ridge 13 of helical waveguide slow wave structure 50. Sleeve 43 is supported at one end 45 by wall 44 of waveguide 42, and at its other end 46 there is a circular aperture 47 in wall 48 bounded by the circular perimeter 49 of a cut-out of wall 48. Waveguide 42 is terminated by a short-circuiting end wall 49 which is longitudinally displaced from the sleeve 43. The displacement (usually one-eighth to one-quarter wave-length), and the diameter and length of sleeve 43 determine the impedance and coupling of waveguide 42 to slow wave structure 50. A preferred coupling structure will be described in detail in conjunction with the traveling wave tube shown in FIGS. 11 and 12.

Figure 2:
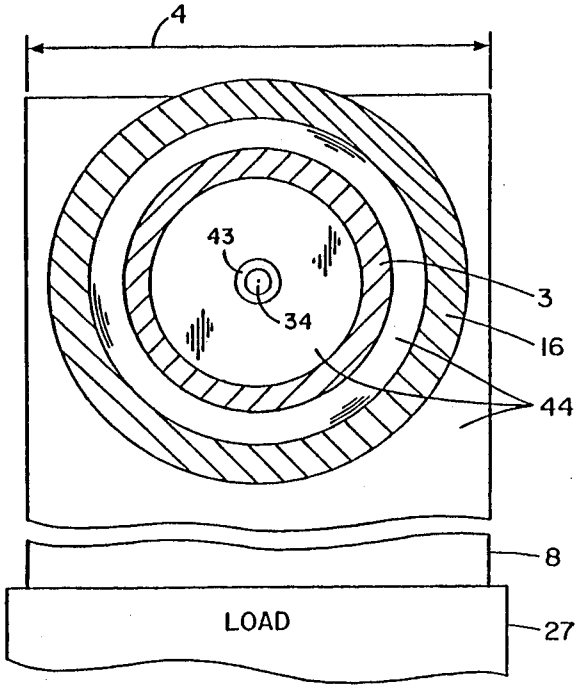
FIG. 2 is an end view taken along section line II—II of FIG. 1.

FIG. 2 is an sectional end view taken along section line II—II of FIG. 1 showing the width 4 of the waveguide 42 in relationship to the tube 1 wall 3 and toroidal magnets and iron discs 16, 17, respectively.

Sleeve 43 couples electromagnetic energy from the signal source 26 to the slow wave structure 50 where the electromagnetic energy across gap 31 interacts with the electron beam 14 to be amplified and to advance along the slow wave structure 50 to the output coupler 8 where the energy is coupled to the load 27. The energy travels helically down the traveling wave tube 1 in the spiral space 30 which exists between spiraling radially directed screwthreads 12. The spiral path taken by the electromagnetic energy is passing down the slow wave structure 50 from the input end to the output end of the traveling wave tube reduces the effective axially-directed velocity of the voltage generated in the gap 31 between the proximate edges 32, 33 of the spiraling ridge 13 to substantially the same velocity as that of the electrons of the electron beam 14 as they travel axially down the traveling wave tube. As a result of approximate equality of the axial velocity of the electric field in gap 31 between the adjacent ridges 13 and the electron beam 14 velocity, there is coupling of the input electromagnetic energy to the electron beam in such a way as to cause amplification of the electromagnetic energy as the beam travels down the axis 15 of the tube 10 in a manner well known to those skilled in the traveling wave tube art.

Fabrication of a waveguide slow wave structure 50, such as that shown in FIG. 1, would be difficult even for those instances where the traveling wave tube operates at relatively low frequencies thereby allowing the dimensions of the slow wave structure 50 to be relatively large. The construction of a slow wave structure 50 for use in traveling wave tubes which operate at very high frequencies, i.e., 43–46 GHz as in this invention, requires innovative fabrication techniques. At these frequencies, a slow wave structure 50 has a typical dimensions: a screwthread 12 diameter of approximately onequarter of an inch, an overall length of one inch, a pitch of approximately 0.04 inch, and a central hole 34 diameter of substantially 0.04 inch for the passage of the axially-directed electron beam 14. Fabrication of a slow-wave structure 50 of these dimensions requires manufacturing techniques which depart greatly from the standard techniques for fabricating slow-wave structures known to those skilled in the art of manufacturing traveling wave tubes.

The process of manufacturing the slow-wave structure 50 of this invention begins with a solid bar of copper of slightly larger diameter and length than the corresponding dimensions of the slow-wave structure, a little larger than one-quarter of an inch and one inch, respectively, for the exemplary structure. The length of the bar is greater than the length of the finished slow-wave structure 50 to facilitate machining of the bar. The first step in the fabrication process is to reduce the diameter of the bar to the precise diameter (within the allowed tolerance, in our case, 0.2450 max./0.2446 min. inches) of the slow-wave structure 50 by conventional lathe machining techniques. Machining the bar to a cylindrical form establishes its central axis 15.

Figure 3:
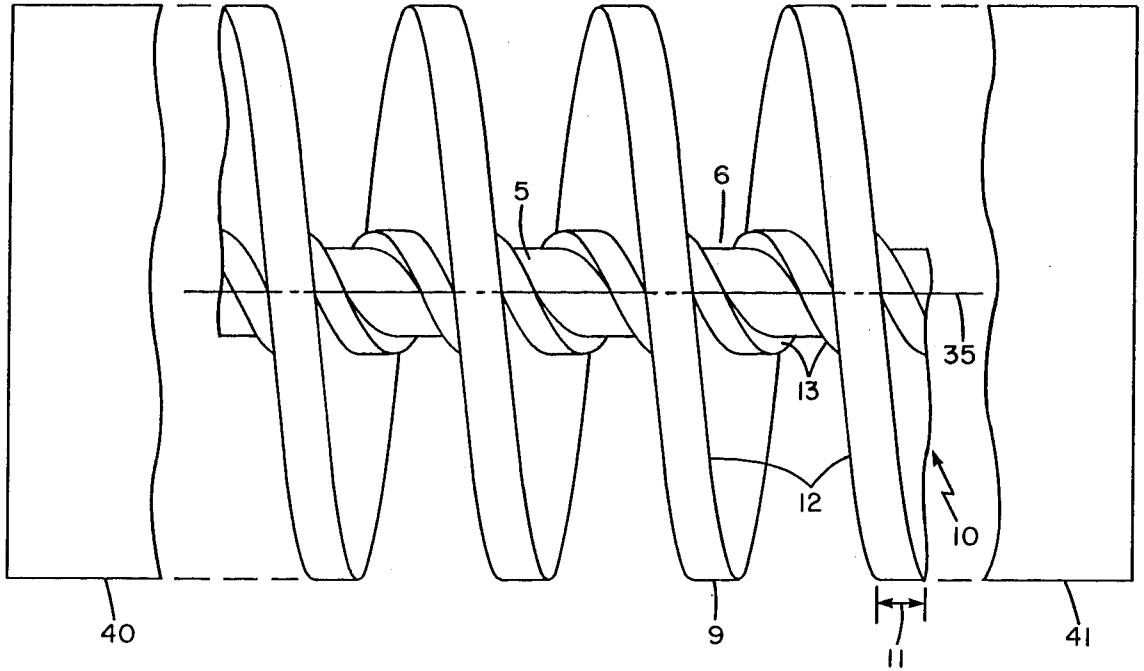
FIG. 3 is a side view of the slow wave structure of FIG. 1 prior to completion of its fabrication.

The bar is secured at both its ends 40, 41 while being delicately machined on a lathe to form the screwthread-like structure 10 shown in broken side view in FIG. 3. The delicateness of the machining required to fabricate the structure 10 is made evident by the following typical dimensions where the width dimension 11 of the screwthreads is 0.0202 inches max./0.0198 inches min. The screwthreads 12 terminate on a ridge 13 whose diameter is 0.0532 inches max./0.0528 inches min. A groove 6 is machined to be centrally located between the screwthreads 12 and have a diameter 0.039 inches max./0.037 inches min. and a width of 0.0322 inches max./0.0318 inches min. typically, to form care 5. The screwthread-like structure 10 extends at a minimum over the length of the desired finished slow wave structure which, in this example, is 1.002 inches max./ 0.998 inches min.

The next step in the fabrication of the slow-wave structure is to form, by conventional lathe machining techniques, a cylindrical sleeve of copper 38 having an outer diameter of 0.344 inches max./0.343 inches min. and inner diameter of 0.2455 inches max./0.2452 inches min. The inner and outer diameters of the sleeve 38 are concentric with respect to one another within 0.001 inches. The length of the sleeve 38 is 1.001 inches max./0.999 inches min. The sleeve 38 is slid over the slow-wave structure 10 of FIG. 3 after which the sleeve 38 is brazed to the periphery of the screwthreads 12. Sleeve 38 provides structural support for the screwthread structure 10 thereby allowing the ends 40, 41 to be removed by machining to cause the screwthread structure 10 to be contained within the sleeve 38.

Figure 4:
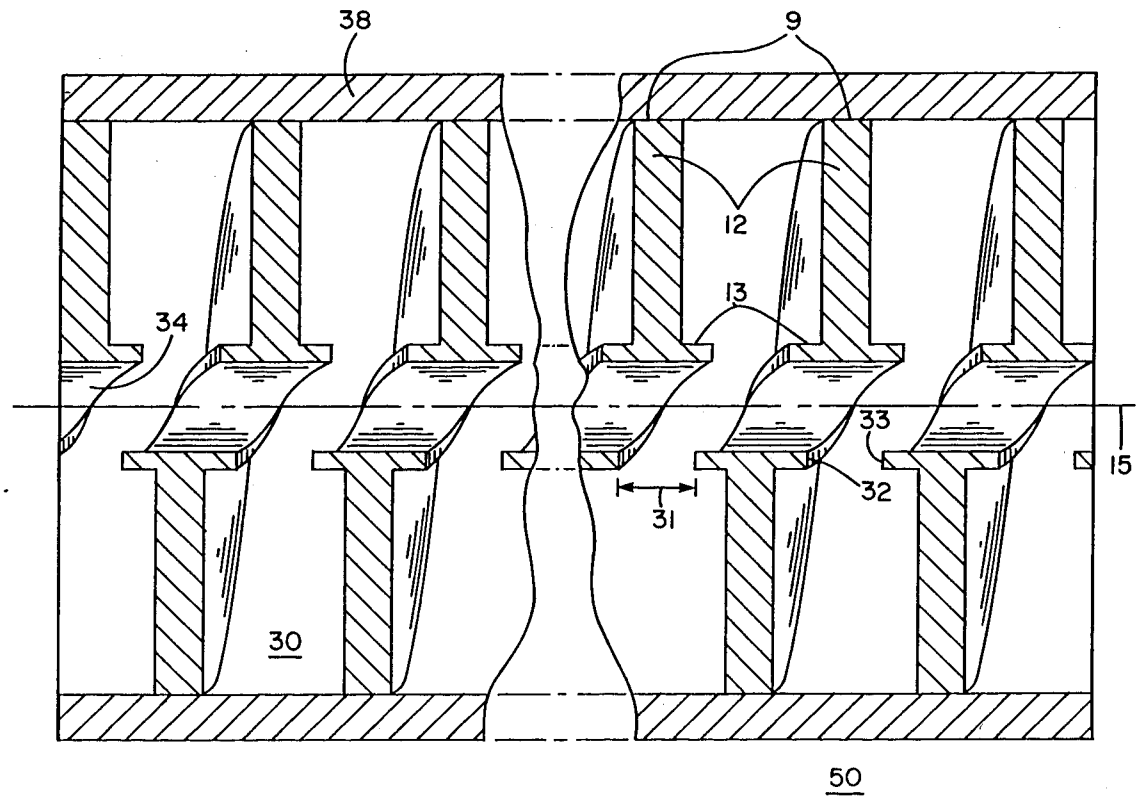
FIG. 4 is a longitudinal cross-sectional view of the completed slow wave structure of this invention.

The next step in the fabrication of the finished slow-wave structure 50 of FIG. 4 is to remove the core 5 of the slow-wave structure 10 leaving the ridges 13 and their associated screwthreads 12 as shown in FIG. 4. The material to be removed has a diameter 0.039 inches max./0.037 inches min. which corresponds to the diameter of the central core 5 forming the base of the groove 6. The core 5 is removed by using an electric discharge machine which uses a pointed electrode centered on the axis 35 to erode the central core 5 of the structure 10 of FIG. 3 so that all the core 5 out to the bottom of groove 6 is removed leaving only the ridge 13 and its associated screwthread 12. A fluid is used to remove the particles that are being eroded by the electrode as the process of electric discharge machining takes place. Control of the electric discharge machining may be maintained by observing the uniformity of the erosion of the material 5 between adjacent edges of the ridges 13. If desired, the material 5 may be removed in one pass of the electrode down the axis 15 of the screw-like structure 10 or the material may be removed in two or more passes of the electrode depending upon the skill of the operator of the electric discharge machine. The slow wave structure 50 with is central core 5 removed and with the sleeve 38 brazed to the periphery 9 of screwthreads 12 is shown in the cross-sectional view of FIG. 4. The structure 50 of FIG. 4 is the slow wave structure of the traveling wave tube 1 of FIG. 1.

A slot-coupled cavity delay line or slow-wave structure embodiment of this invention is fabricated in a manner similar to that used in the fabrication of the helical delay line, wherein disks are machined into a bar of copper while retaining a center support structure.

Another preferred embodiment of the invention in which a method different from the method of the prior art provides fabrication of a slot-coupled disk delay line of FIGS. 5–8 or slow-wave structure will next be described. The method produces disks which are machined from a bar of copper while retaining a center support structure for the disks resulting in a slow-wave structure which is superior to that of the prior art in both cost of fabrication and electrical performance.

Figure 5:
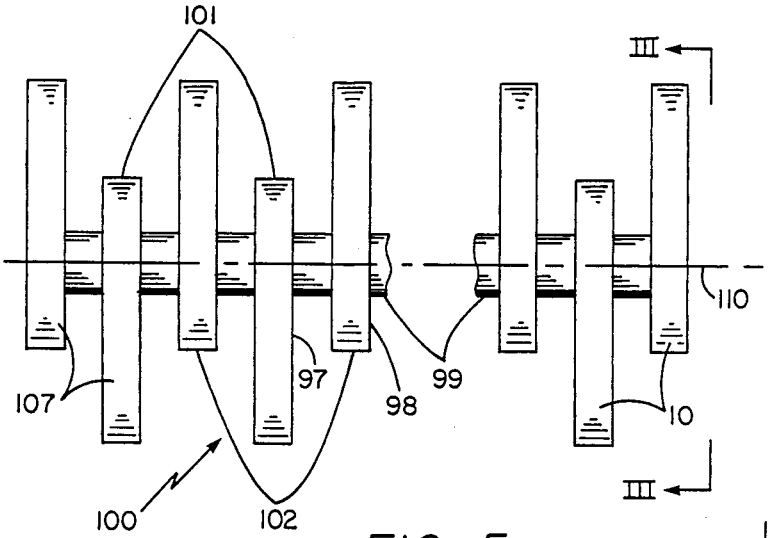
FIGS. 5, 6 and 7 are side, end, and isometric views, respectively, of the disk subassembly of another embodiment of the invention.
Figure 6:
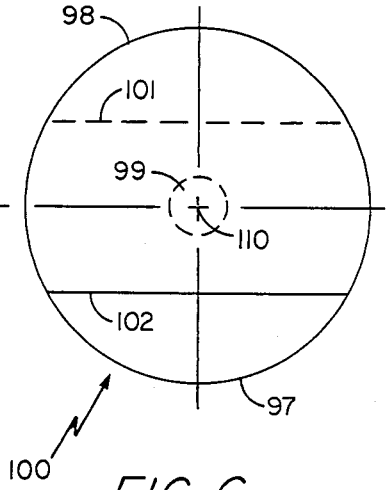

A solid bar of oxygen-free, high conductivity copper is conventionally machined to form a cylinder. In order to illustrate the problems of fabrication solved by the method of this invention, the diameter of the cylinder may be only 0.233 inches with an overall length of 3.5 inches for the fabrication of the coupled cavity slow-wave structure for use in a traveling wave tube for the tens of GHz frequency band. The next step in fabrication is to conventionally machine the cylinder on a lathe to initially form round disks 97, 98. The disks are typically 0.053 inches in thickness with a gap between disks of 0.0265 inches. A central supporting member 99 is retained during the machining operation in order to support the disks 97, 98 and maintain them in position. The diameter of the supporting structure 99 is typically only 0.039 inches. The round disks 97 are next machined by milling to provide a flat surface 101, and the disks 98 are machined to have oppositely disposed flat surfaces 102. An end view taken along view line III—III of the machined structure 100 of FIG. 5 is shown in FIG. 6. An isometric view in FIG. 7 of the machined cylinder 100 clearly shows the disks 97, 98 with their flat surfaces 101, 102.

Figure 8:
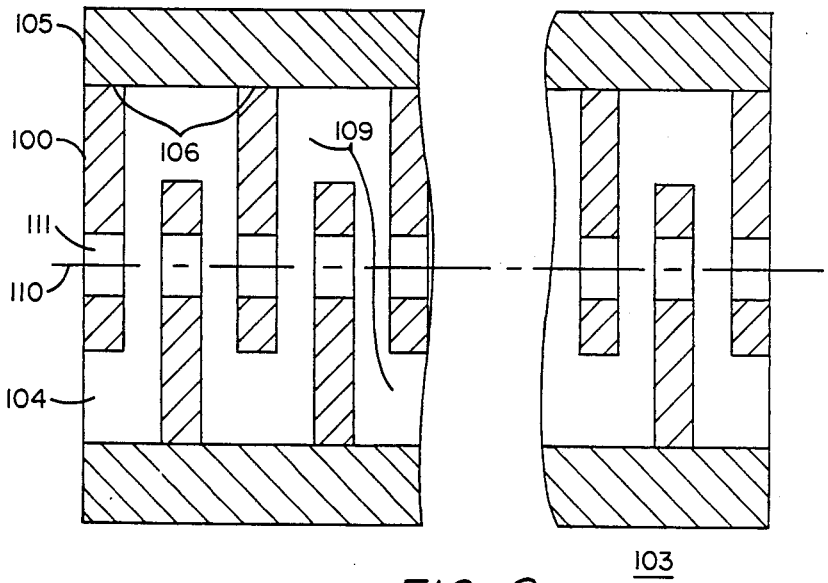
FIG. 8 is a cross-sectional view of another embodiment of a complete slow-wave circuit showing the modified disk structure of FIGS. 5–7.
Figure 7:
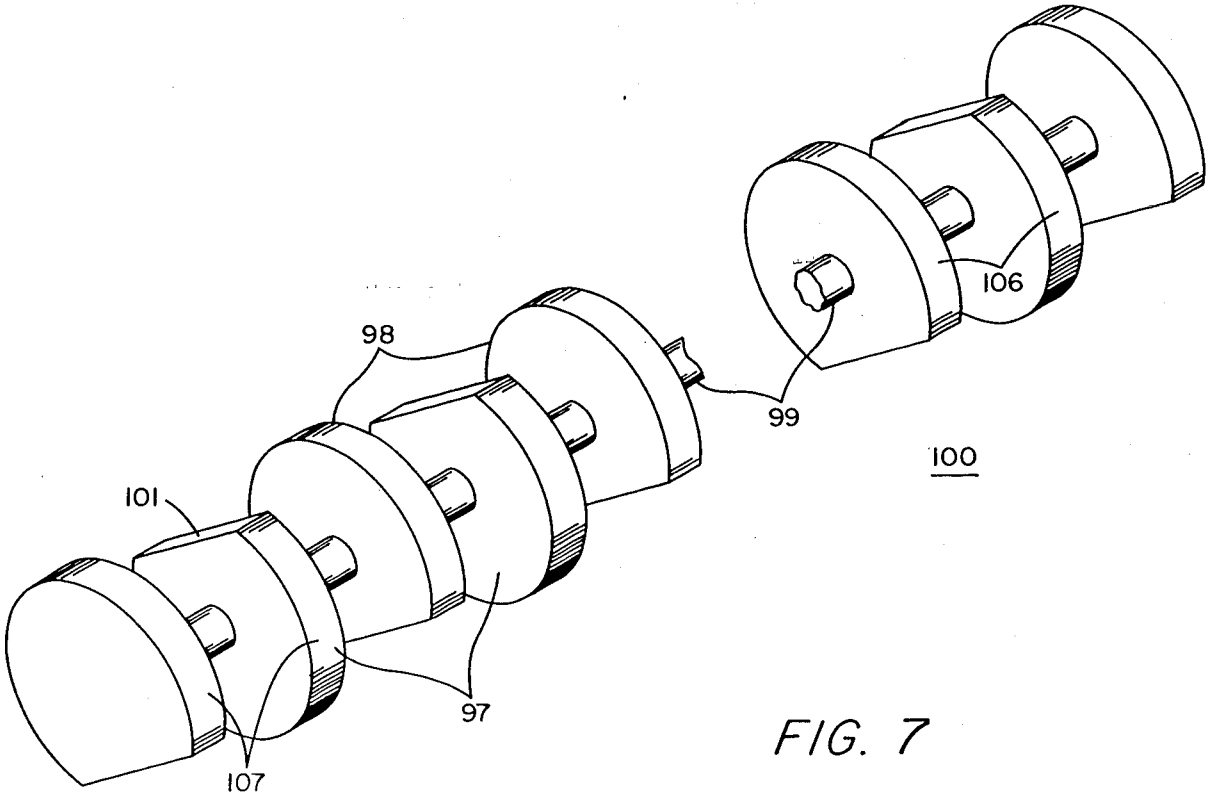

The next step in the process of fabricating the slot-coupled delay line 103 of the invention, shown in FIG. 8, is to braze the machined structure 100 into the cylindrical hole 104 of a cylindrical shell 105 having the same length. The shell 105 has an internal diameter just slightly larger than the diameter of the machined structure 100, typically 0.2334 inches. The shell 105 is also comprised of oxygen-free, high conductivity copper and the braze is accomplished by using a gold film 106 coating on the periphery 107 of the disks 97, 98 except for flat surfaces 101, 102 of FIGS. 5–7. The gold film 106 is preferably applied to the cylinder prior to the machining operations resulting in the structure of FIGS. 5 and 7. The machining operations remove the gold film 106 from those portions of structure 100 which form the electromagnetic cavities of the completed delay line in order that electric fields within the delay line 103 experience electrical loss only from the high conductivity copper and not the relatively lossy gold film. The braze occurs at the gold-film contact area of the disks 97, 98 and the copper shell 105. This brazing operation occurs prior to the removal of the supporting member 99. It should be noted that the coupling holes 109 produced by the space between the flat surfaces 101, 102 of disks 97, 98 and shell 105 can be alternately on opposite sides of the axis 110 as shown in FIG. 8. Alternatively, the coupling holes 109 may be placed on the same side of axis 110 to provide single-slot in-line coupling or on both sides of axis 110 for two-slot in-line coupling (neither form being shown in the figures) depending upon the type of coupled cavity slow-wave structure which is desired. These different types of coupling are accomplished by machining the disks 97, 98 so that operation for single-slot coupling, in-line flat surfaces 101, 102 would be provided on disks 97, 98, respectively, whereas for two-slot in-line coupling, flat opposed surfaces 101, 102 would be provided on all the disks 97, 98. After the brazing operation has occurred, the cylindrical supporting member 99 is removed by drilling a pilot hole parallel to axis 110 followed by electric discharge machining by a wire threaded through the pilot hole to provide an electron beam hole or tunnel 111 throughout the length of the assembled delay-line or slow-wave structure 103 shown in FIG. 8.

The typical dimensions which have been given for the preceding slow-wave structure 103 are illustrative for an alternate slot-coupled cavity TWT (not shown) designed to operate at 44 GHz. Final dimensions would have to be determined by detailed design computation, but the dimensions given are adequate to illustrate the nature of the size of the components of the delay line 103 of this invention.

Figure 9:
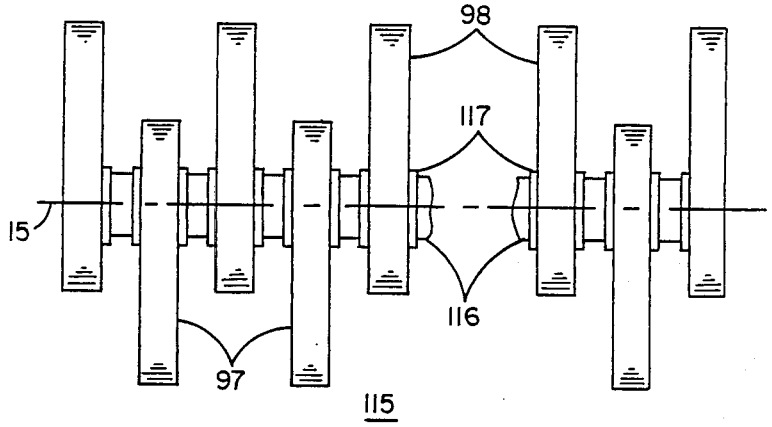
FIG. 9 is a side view of another embodiment of a disk assembly made in accordance with the invention.
Figure 10:
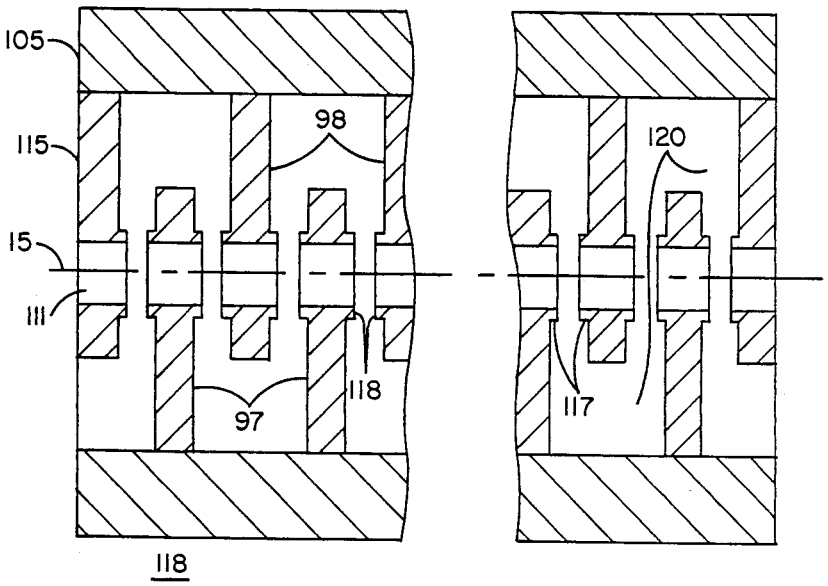
FIG. 10 is a cross-sectional view of still another embodiment of a slow-wave circuit with the modified disk structure of FIG. 9.

The machined cylindrical structure 115 of an alternate embodiment of the invention is shown in side view in FIG. 9. In this alternative design, the machined cylindrical structure 115 of FIG. 9 has a cylindrical supporting structure 116 having a slightly larger diameter ridge or ferrule 117 on each side of the disks 97, 98. After brazing the structure 115 of FIG. 9 into a shell 105 as earlier described, the supporting cylinder 116 is removed by the wire electric discharge machining procedure previously described to result in the slow-wave structure 118 shown in longitudinal cross-section in FIG. 10 having the electron beam hole 111. The ferrules 117 are retained in this machining operation to provide increased capacitance between the adjacent edges 118 of the ferrules 117 and thereby increase the coupling impedance of the cavities 120 to the electron beam 14 of FIG. 1 which would pass along the axis 15 in the TWT 1 of FIG. 1 when the slow-wave structure 118 of FIG. 10 is incorporated instead of slow-wave structure 50 of FIG. 1.

Figure 11:
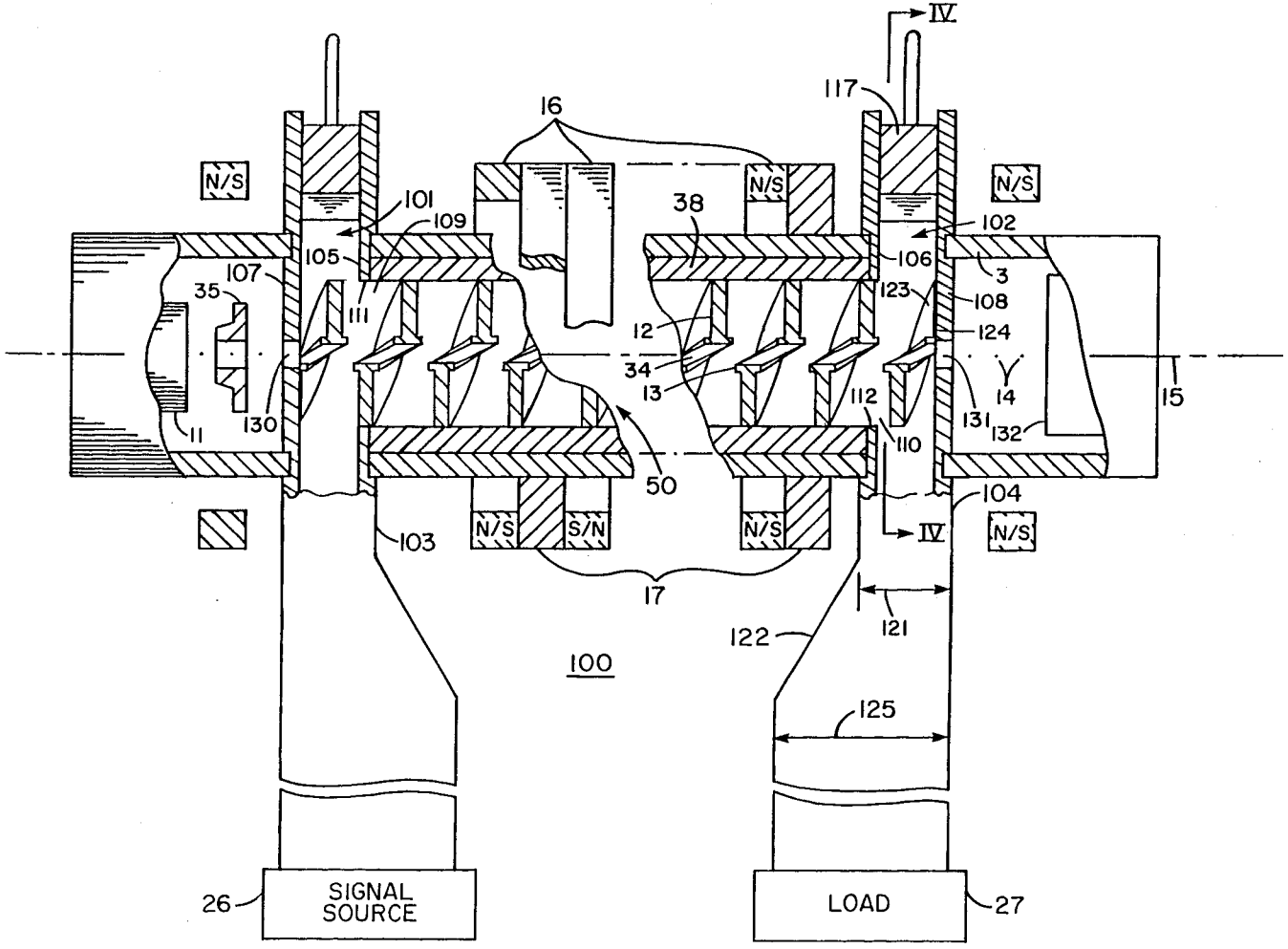
FIG. 11 is an axial cross-sectional view of the embodiment of the traveling wave tube of FIG. 1 with a different preferred embodiment of the input and output coupling circuit.

Referring now to FIG. 11, there is shown a traveling wave tube 100 which incorporates an improved input coupling circuit 101 and output coupling circuit 102. Corresponding elements of FIGS. 1 and 11 are correspondingly numbered. A feature of the couplers 101, 102 is that the helical waveguide axis 15 is at an angle of 90° to the input and output rectangular waveguides 103, 104, respectively. Waveguides 103, 104 have apertures 109, 110 in their respective flat width walls 105, 106 which are in contact with the cylindrical wall 38 of the helical waveguide 50. The apertures 109, 110 being of equal diameter to the inner diameter of the cylindrical wall 38 allows the helical screwthread 12 to extend beyond walls 105, 106 and to terminate flush with the outermost flat width walls 107, 108, respectively, of the input and output couplers 101, 102. The apertures 109, 110 have perimeters 111, 112, respectively. The outermost walls 107, 108 have apertures 130, 131, respectively, which are of the same diameter as electron beam tunnel 34 to allow passage therethrough of the electron beam 14.

Figure 12:
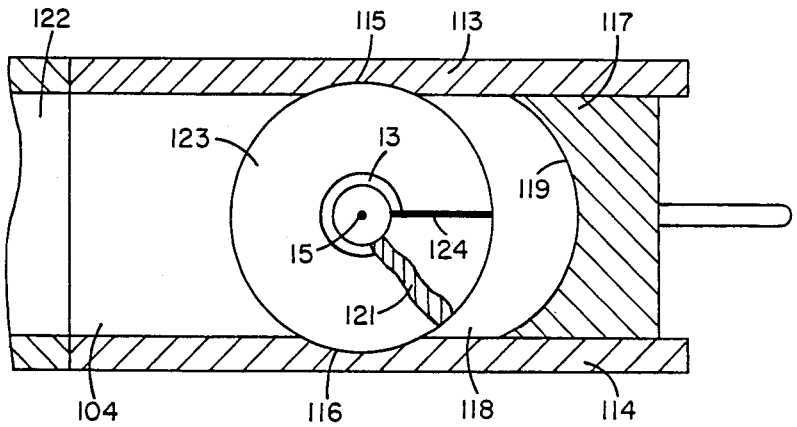
FIG. 12 is an end sectional view of FIG. 11 taken along section line IV—IV of FIG. 11.

An end view of output coupler 102 along section line IV—IV is shown in FIG. 12. The spiral screwthread 12 is shown terminated at its flush termination with the end wall 108 of the waveguide 104. The side walls 113, 114 of the waveguide 104 make contact with the spiral 12 in the regions 115, 116, respectively. The waveguide 104 short-circuiting termination plug 117 is moved along the length of the waveguide 104 to adjust the space 118 between the spiral 12 and the face 119 of the plug. The line 120 indicates the line of contact of the spiral 12 with the outer wall 108 of waveguide 104. Crosshatched region 121 is the portion of spiral 12 which is intersected by section line IV—IV.

Impedance match of the load 27 to the helical waveguide 50 at the output of the TWT 100 is accomplished by the following. The rectangular waveguide 104 height is tapered from the normal height 125 for WR22 waveguide to a reduced height 121 at the coupler 102. The taper 122 is made long in order to provide low reflection from the change in height 122. The reduced height is chosen to provide a waveguide impedance which more closely matches that of the helical waveguide 50. It has been found in at least one embodiment of the invention that a height 121 less than half the pitch of the helix 12 provides a good impedance match. Rotation of the helical waveguide 50 relative to the rectangular waveguide 104 is also adjusted for optimum match. Tapering of the helical waveguide pitch and the diameter of the end of the helix 12 vane 123 where it meets the outer wall 108 of waveguide 104 is also found to help provide a match.

Since no theoretical analysis of the coupler circuit 102 exists, the coupler design was derived experimentally. Reduced height WR22 rectangular waveguides are fabricated such that the helical waveguide vane 123 extends into the waveguide through the widest wall of the waveguide as shown in FIG. 12. The best transmission match was obtained with the helix 12 brazed to the outer wall of a 0.030 inch inside height waveguide which tapers to a full height WR22 waveguide. For the 0.030 inch height, the pitch of the helix 12 was 0.040 inches. Tuning of the impedance match was accomplished as stated above by rotating the coupler 102 relative to the axis 15 of the helical slow-wave structure 50 before brazing the helix end 124 to the outer wall 108. The helical vane 12 is terminated at the outer wall 108 by its end 124 which forms a plane transverse to the axis 15 so that end 124 forms a smooth transition with the wall 108. After the braze, the position of the back plug 117 was adjusted to provide a space 118 providing minimum reflection as seen from the load 27 and the plug is brazed in this position.

Input coupler 101 is a duplicate of output coupler 102 and the preceding comments with respect to matching apply to the matching of the waveguide 50 at the input of the traveling wave tube 100 to the source 26.

Having described a preferred embodiment of the invention, it will be apparent to one of skill in the art that other embodiments incorporating its concept may be used. It is felt, therefore, that this invention should not be limited to the disclosed embodiment but rather should be limited only by the spirit and scope of the appended claims.

What is claimed is:

1. A helical waveguide to rectangular waveguide coupler comprising:

a helical waveguide having an axis of symmetry with an outer cylindrical wall and a longitudinally extending helical vane interior to and electrically connected to said cylindrical wall;

a rectangular waveguide having a top and bottom wall transverse to said axis;

said top wall having a first aperture through which side helical vane has an end portion which extends into said rectangular waveguide and is in contact with said bottom wall; and said outer cylindrical wall and said top wall being electrically connected.

2. The coupler of claim 1 wherein said rectangular waveguide comprises a short-circuiting termination plug within one portion of said rectangular waveguide and substantially the same size as said rectangular waveguide spaced from said helical vane extending within said rectangular waveguide.

3. The coupler of claim 2 wherein said plug has a curved face facing said extended helical vane with substantially the same diameter and direction of curvature as the circumference of said helical vane.

4. The coupler of claim 2 wherein:

said plug is longitudinally movable within said rectangular waveguide to provide a variable spacing between said helical extending vane and said plug; and the spacing is established to provide a match to the portion of said rectangular waveguide on the other side of said extending helical vane.

5. The coupler claim 4 wherein said plug is brazed to said rectangular waveguide at the established spacing providing said match.

6. The coupler of claim 5 comprising in addition:

said contact of the end portion of said helical vane with said bottom wall is a brazed connection; and the electrical connection of said outer cylindrical wall to said top wall is a brazed connection.

7. The coupler of claim 1 wherein:

said bottom wall of said rectangular waveguide is transverse to said axis; and said helical vane has a longitudinal axis and forms a terminating plane transverse to said axis so that said vane end forms a smooth transition with said bottom wall where said vane end contacts said bottom wall.

8. The coupler of claim 7 wherein:

said rectangular waveguide has a longitudinal axis; and said helical vane termination on said bottom wall forms an angle with said longitudinal axis which angle results in matching the impedance of said helical vane to said rectangular waveguide.

9. The coupler of claim 1 wherein said extended portion of said helix has a different pitch within said rectangular waveguide than the pitch within said cylindrical wall.

10. The coupler of claim 1 wherein:

said contact of the end portion of said helical vane with said bottom wall is a brazed connection; and the electrical connection of said outer cylindrical wall to said top wall is a brazed connection.

11. The coupler of claim 1 comprising in addition:

said helical waveguide having a second circular aperture centered on a longitudinally extending axis of symmetry; and said rectangular waveguide having a third circular aperture in its bottom wall centered on said axis.

12. A traveling wave tube comprising:

a helical waveguide having an axial aperture and an outer cylindrical wall and a longitudinally extending helical vane interior to and electrically connected to said cylindrical wall;

a first and second rectangular waveguide having a top and bottom wall;

said top wall having an aperture through which said helical vane has an end portion which extends into said rectangular waveguide and is in contact with said bottom wall;

said outer cylindrical wall and said top wall being electrically connected;

said bottom wall having an aperture;

means for providing an electron beam along said aperture of said top and bottom walls of said first and second rectangular waveguides;

said helical waveguide being between said first and second rectangular waveguides; and means for collecting said electron beams after passing through said helical and first and second rectangular waveguides.

* * * * *